United States Patent [19]

Jackson

[11] 4,050,431

[45] Sept. 27, 1977

[54] FUEL INJECTION SYSTEMS FOR INTERNAL COMBUSTION ENGINES

[75] Inventor: Harold Ernest Jackson, Plymouth, England

[73] Assignee: Tecalemit Limited, England

[21] Appl. No.: 685,444

[22] Filed: May 12, 1976

[30] Foreign Application Priority Data

May 15, 1975 United Kingdom ..... 20646/75

[51] Int. Cl.[2] ..... F02M 39/00

[52] U.S. Cl. ..... 123/139 AW; 123/139 BG

[58] Field of Search ..... 123/139 AW, 139 AP, 123/139 AS, 139 BG

[56] References Cited

U.S. PATENT DOCUMENTS

| | | | |
|---|---|---|---|
| 3,463,129 | 8/1969 | Babitzka et al. | 123/139 AW X |
| 3,730,155 | 5/1973 | Knapp | 123/139 AW X |
| 3,739,762 | 6/1973 | Jackson | 123/139 AW X |
| 3,983,849 | 10/1976 | Stumpp | 123/139 AW X |

*Primary Examiner*—Edgar W. Geoghegan

*Attorney, Agent, or Firm*—Kane, Dalsimer, Kane, Sullivan and Kurucz

[57] ABSTRACT

A fuel injection system of the type in which the injectors can be operated to discharge fuel intermittently. The fuel supply line to the nozzles includes a metering valve which meters fuel continuously, at a rate dependent on an engine operating condition, to a fuel store where the metered fuel remains if the injectors are closed. When the injectors open, the stored fuel is discharged and metered fuel then flows to the injectors until they close again.

14 Claims, 2 Drawing Figures

FUEL INJECTION SYSTEMS FOR INTERNAL COMBUSTION ENGINES

This invention relates to fuel injection systems for internal combustion engines.

Known fuel injection systems fall, in general, into one of two groups:

A. Continuous injection systems in which fuel is metered continuously in dependence on an operating condition of the engine either through open injectors or through injectors including spring-loaded valves which maintain a predetermined pressure in the fuel feed lines.

B. Intermittent injection systems in which the fuel delivery is controlled primarily in dependence on an operating condition of the engine by the opening duration of electromagnetically-operated valves associated with or incorporated in each injector. In some cases a secondary control, by variation in the pressure of fuel supplied to the injectors, is added.

In both groups, problems arise due to the wide range of fuel flows required in the operation of an automobile engine. The normal speed range of an engine is from 500 r.p.m. to 6000 r.p.m. and the maximum and minimum quantities of fuel required per cycle are in the ratio of about 3.5/1. The maximum and minimum fuel flows are in the ratio of about 42/1.

In a continuous injection system, a maximum to minimum fuel flow ratio of 42/1 results in a required maximum to minimum fuel pressure ratio at the injectors of about 1760/1. The maximum fuel pressure available is of the order of 100 psi if the use of very expensive high pressure fuel pumps is to be avoided but this means that, at the engine condition requiring the lowest fuel flow, the pressure at the injectors is only 0.057 psi which is far too low to prevent vaporization of the fuel at high engine temperatures.

One solution to this problem, which has been proposed, is to provide each injector with its own metering system and an arrangement of pressure-controlled valves which maintain the pressure of fuel up to the point of injection at a level high enough to suppress vaporization. This solution to the problem is very expensive and presents serious production problems because of the high degree of precision required in manufacture of the components.

In an intermittent injection system, if injection occurs once per revolution, the time available for each injection when the engine is operating at 6000 r.p.m. is only 10 m/s. For practical reasons the usable time is only 9 m/s and, to provide maximum and minimum quantities of fuel per cycle in the ratio of 3.5/1, the minimum injection interval must be about 2.6 m/s. It is difficult and expensive to manufacture electro-magnetically operated injectors which meter fuel accurately at this very low operating time because a large proportion of the 2.6 m/s is used in actually opening and closing the injector and the true duration of complete opening of the injector may be less than 1 m/s. Moreover, complex and expensive electronic circuits for controlling the injectors are required to match the air flow and fuel flow. These circuits require elaborate corrective devices to minimize the effects of ambient temperature and battery voltage variations.

The present invention provides a fuel injection system for an internal combustion engine, including at least one injector valve which is connected to receive fuel from a fuel store and which, when open, allows fuel from the store to be discharged by at least one injector nozzle, a metering valve operable to meter fuel continuously to the store at a rate dependent on an engine operating condition, and control means operable to open the injector valve intermittently.

In use of the system, the metering valve meters fuel to the fuel store regardless of whether the injector valve is open or closed. If the injector valve is closed, the metered fuel is stored: when the injector valve opens, the stored fuel is discharged by the injector nozzle and fuel then flows to the nozzle at the rate determined by the metering valve until the injector valve closes. The amount of fuel discharged need not be materially dependent on the length of time for which the injector valve is open.

The control means may be operable to open the injector valve for constant periods of time, or to open the injector valve for periods of time which vary in dependence on at least one engine operating condition, or even to open the injector valve intermittently only under predetermined engine operating conditions, the injector valve then being open continuously under other engine operating conditions. Preferably, the control means is operable to open the injector valve for periods of time of a first length when the engine intake manifold depression is below a predetermined value and for periods of time of a second length when the intake manifold depression is above that value.

The metering valve may be operable to meter fuel at a rate dependent on air flow to the engine. In embodiments of the invention the metering valve is operable to meter fuel at a rate dependent on the position of an air valve which is located in the engine air intake conduit and which is movable in response to changes in the air flow to the engine. These embodiments include pressure control means operable to vary the pressure drop across the metering valve in dependence on the pressure drop across the air valve.

By way of example, fuel injection systems constructed in accordance with the invention will be described with reference to the accompanying drawing in which.

Figure 1:
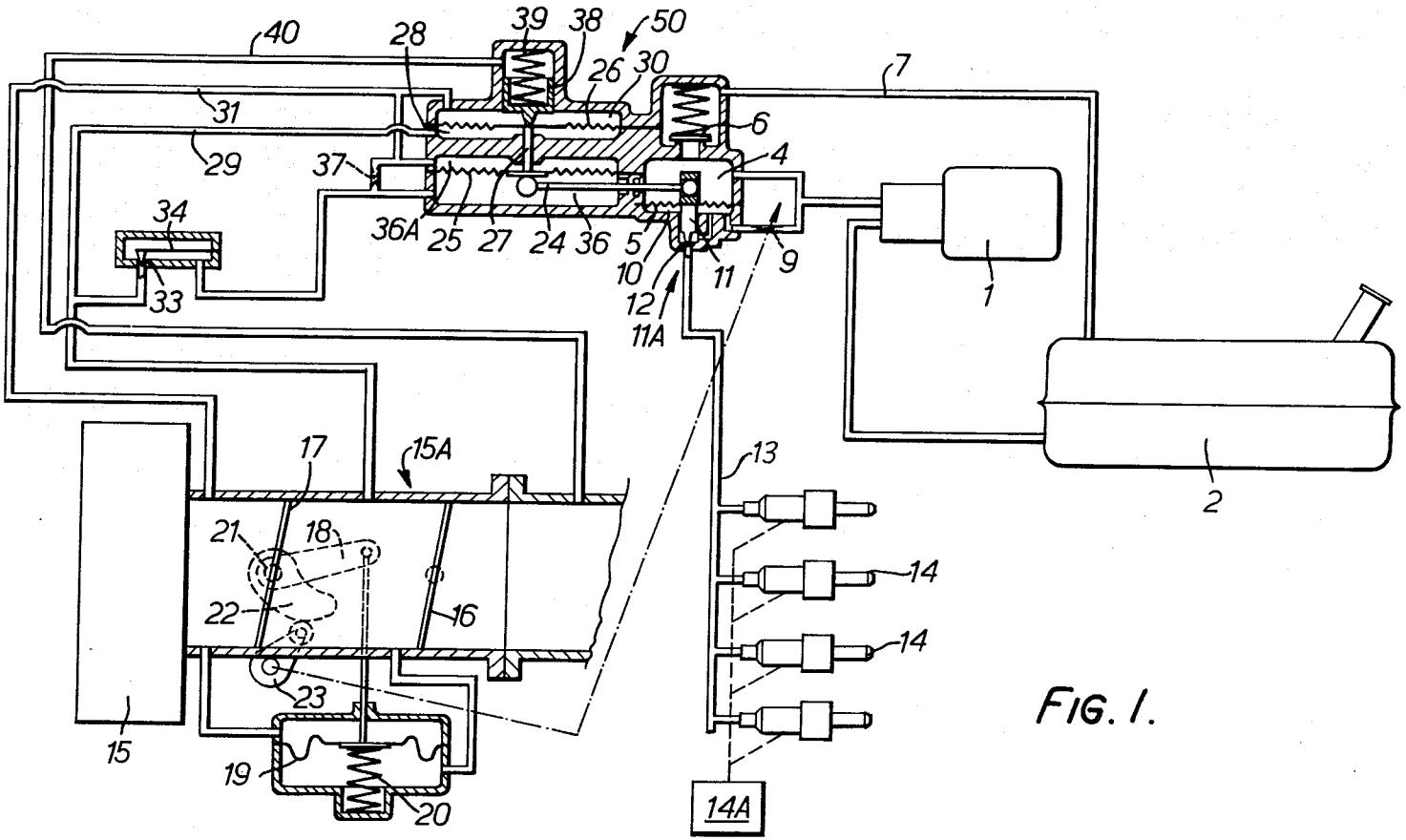
FIG. 1 is a diagram of one system embodying the invention.

In the system shown in FIG. 1, a pump 1 draws fuel from a tank 2 and delivers it to a chamber 4 on one side of a diaphragm 5 and, through a metering valve 9, to a chamber 10 on the other side of the diaphragm. The chamber 10 constitutes a fuel store as will be described below and forms part of a fuel pressure control unit indicated generally at 50. A regulator 6 maintains the fuel pressure in chamber 4 at a predetermined level and surplus fuel passes through pipe 7 back to the tank 2. Fuel flow from the chamber 10 is controlled by a fuel pressure control valve 11A, comprising a valve member 11 which is attached to the diaphragm 5 and co-operates with a seating 12 through which fuel can pass via a feed line 13 to injectors 14 which incorporate electromagnetically-operated valves (not shown). The injectors are positioned to discharge fuel into the intake manifold system of the engine.

Operation of the metering valve 9 is controlled in dependence on the air flow to the engine, represented by the adjustment of an air valve 17 in the engine air intake conduit 15A, as will be described below. Movement of the diaphragm 5, and hence operation of the pressure control valve 11A, is controlled by the fuel pressures in chambers 4 and 10 and also, as will be described below, by the pressure difference across the air valve 17.

Air enters the intake conduit 15A through an air cleaner 15, and the air valve 17 is located between the air cleaner and the customary pedal-operated throttle valve 16. The position of the air valve 17 is controlled, through a lever 18, by a spring-biased diaphragm 19 which is exposed, on one side, to the depression between the air and throttle valves 17, 16 and, on the other side, to the depression between the air cleaner 15 and the air valve 17. Thus, in operation, the position of the air valve varies with changes in air flow to the engine, and the pressure difference across the air valve 17 is, throughout, determined by the spring 20 biasing the diaphragm 19. The actual value of the pressure drop across the air valve 17 is immaterial but, to minimize power loss, it should be comparatively small for example 20 cm $H_2O$.

The air valve 17 is coupled to the fuel metering valve 9 through a cam 22 mounted on the spindle 21 of the air valve and engaging a lever 23 which is coupled to the metering valve as indicated by the dotted line connection. The metering valve may have any suitable form: preferably, it comprises a rotatable cylindrical sleeve to which the lever 23 is coupled, the sleeve having an accurately-finished bore in which an axially-drilled fixed pin is located. A triangular port in the pin communicates with the axial drilling and co-operates with a rectangular aperture in the sleeve to define a variable metering orifice.

The valve member 11 of pressure control valve 11A is coupled, through a rocking lever 24 pivoted at a point along its length, to a diaphragm 25 separating two air chambers 36, 36A in which, for the present, the pressures can be assumed to be equal. A diaphragm 26, bearing on a pin 27 which in turn bears on the diaphragm 25, is exposed on one side, through chamber 28 and pipe 29, to the depression between the air and throttle valves 17, 16 and on the other side, through chamber 30 and pipe 31, to the depression between the air cleaner 15 and the air valve 17. The pressures in chambers 28 and 30 can, for the present, be assumed to be the only ones acting on the diaphragm 26 and the result is a downward force on the diaphragm (as seen in the diagram) determined by the pressure difference across the air valve 17.

The downward force on diaphragm 26 is transferred, through the pin 27 and diaphragm 25 to the end of the lever 24 and results, at the other end of the lever, in an upward force on the diaphragm 5 and valve member 11. The valve member 11 is thus caused to move away from its seating 12 until the upward force on the diaphragm 5 due to the beam 24 and the fuel pressure in the chamber 10 equals the standing fuel pressure in the chamber 4.

It will be noted that, in this arrangement, the lever 24 performs a dual function in that it acts as a pivot and also separates fuel in chamber 4 from air in chamber 36.

The electromagnetic valves of the injectors 14 are opened, by control means 14A, for a predetermined length of time at least once in each engine cycle. The manner in which the injector valves are opened forms no part of the present invention but, as will be described briefly below, they are preferably operated by a signal derived from the ignition system of the engine.

When the injector valves are closed, metered fuel from the valve 9 flows into the chamber 10 and is stored, causing the valve member 11 to move away from its seating 12.

When the injector valves open, the fuel stored in chamber 10 is discharged and metered fuel from the valve 9 then flows to the injectors through the valve 11A until the injector valves close.

It will be seen from the above description that the continuous fuel flow through the metering valve 9 (being determined by the adjustment of, and the pressure drop across, the valve) is determined by the adjustment of the air valve 17 and the pressure drop across the air valve, so that, with the system as so far described, a desired ratio of fuel flow to air flow can be maintained throughout the engine operating range.

By a suitable choice of the various characteristics of the storage mechanism, the pressure at which fuel is stored in the chamber 10 and feed line 13 is sufficiently great to suppress vaporization. When the injector valves open the stored fuel is discharged at, substantially, this higher pressure and, although fuel pressure downstream of the metering valve 9 does then drop, it remains at this lower value only until the injector valves close. At higher fuel flows, fuel vaporization is not a problem since even the lower fuel pressure value is sufficiently great to suppress vaporization and, moreover, the flow of fuel will, in itself, maintain the fuel lines at a comparatively low temperature. At low fuel flows, the length of time for which the fuel pressure is at the lower value is a comparatively small proportion of the engine cycle time, hence even at high engine temperatures, very little vaporization can occur. Any vapor which does form will, in any case, be compressed back into liquid form when the injector valves close.

Moreover, even though the injector valves open intermittently, the length of time for which they remain open is not a material factor so far as the amount of fuel supplied to the engine is concerned and it can, accordingly, be sufficiently great to enable a simple and inexpensive switching circuit to be used to control operation of the valves.

For example, if the engine is idling at 500 r.p.m. and there is an injection of fuel once in each revolution, the injector valves can be open for as long as 10 m/s. During the first 2.5 m/s of this period, fuel is discharged substantially at the higher pressure at which it is stored in the chamber 10 and falls to a lower pressure only for the remaining 7.5 m/s of the injection period, being returned to the higher pressure for the 110 m/s for which the injector valves are closed.

As mentioned above, the injector valves open at least once in each engine cycle and are preferably operated by a signal derived from the ignition system of the engine. For example, the impulses from the contact breaker of the ignition system may be passed to a frequency divider which divides the number of impulses in each engine cycle by the number of engine cylinders to yield one injector-operating pulse in each cycle: alternatively, the frequency divider may be such as to yield two injector-operating pulses in each cycle. In either case, each injector-operating pulse may be used to trigger the opening of the injector valves and to start a time cycle at the end of which the injector valves close.

The length of time for which the injector valves are open should always be more than enough to pass the quantity of fuel required by the engine but, within this condition, it may be constant or it may be variable. Preferably there is one constant opening duration for light loads and another constant opening duration for heavier loads: for example, an opening duration of 5 ms can be used whenever the manifold depression is higher than 14 in Hg. with an opening duration of 15 ms being used for lower manifold depressions. Arrangements for sensing the manifold depression and changing the opening duration of the injectors as necessary can readily be devised: for example, the length of time for which the injectors remain open can be determined by the value of resistance in a capacitive timing circuit, a simple vacuum switch being used to sense manifold depression and to change the resistance value of the timing circuit as necessary according to whether the manifold depression is greater or less than 14 in Hg. Another possibility is that the injector valves should be operated intermittently when fuel flow in the system is below a certain value but should remain open (so that the system is, effectively, a continuous one) when the fuel flow is above that value: the fuel flow rate at which the changeover occurs would, of course, be one above which fuel vaporization is improbable.

A further alternative arrangement is one in which the injector valves open for a length of time which, over the whole of the engine operating range, varies in response to at least one engine operating condition for example intake manifold vacuum, angle of throttle valve 16 or angle of air valve 17. Arrangements for varying the period of injector operation are well known and need not be described further: one arrangement for varying the operating period with changes in air valve angle is, for example, described in British patent specification No. 1,286,851.

The injectors 14 themselves may be of any known type incorporating electromagnetic valves which can be opened intermittently. The actual construction of the injectors forms no part of the present invention and need not be described but it can be noted again that the opening duration of the injectors is not a controlling factor in fuel delivery, the function of the injectors being merely to atomize the fuel and deliver it to the engine.

The system shown in the drawing, as so far described, operates to maintain a predetermined ratio of fuel flow to air flow. It is, however, desirable that this ratio should be adjusted so that a richer fuel/air mixture is supplied when the engine is cold and when the engine is operating under full load conditions, and provision for such adjustment is included in the system illustrated.

When the engine is cold, the downward force on the diaphragm 26 of the storage mechanism is augmented by a downward force on the diaphragm 25, which results from the opening of a value 33 in a pipe connecting the chamber 36 on one side of diaphragm 25 to the depression between the air and throttle valves 17, 16. The valve 33 is mounted on a bi-metallic strip 34 which is exposed to engine water temperature to open the valve when the engine is cold. The chamber 36A on the other side of diaphragm 25 is exposed to the depression between the air cleaner 15 and the air valve and a restrictor 37 allows leakage between the chambers 36, 36A.

When the valve 33 is open, a proportion of the pressure drop across the air valve 17 (depending on the degree of opening of valve 33 and hence on engine water temperature) is applied across the diaphragm 25, adding to the load on the beam 24 and thereby increasing the pressure drop across the metering valve 9, which in turn results in increased fuel flow into chamber 10 of the storage mechanism. When the water temperature rises, the valve 33 closes and the pressure drop across the diaphragm 25 disappears due to the restricted connection 37 between the chambers 36, 36A.

When the engine is developing full power, the downward force on the diaphragm 26 is again augmented, this time by a piston 38 engaging the diaphragm. The piston 38 is exposed through a pipe 40 to the depression downstream of the throttle valve 16 (intake manifold depression) and, under light loads when the manifold depression is high, is pulled out of engagement with the diaphragm 26 against the action of a biasing spring 39. As the engine load increases and manifold depression drops, the piston 38 is moved by the spring 39 into engagement with the diaphragm 26 thereby progressively increasing the load on the lever 24 which in turn results in increased fuel flow into chamber 10 of the storage mechanism.

Figure 2:
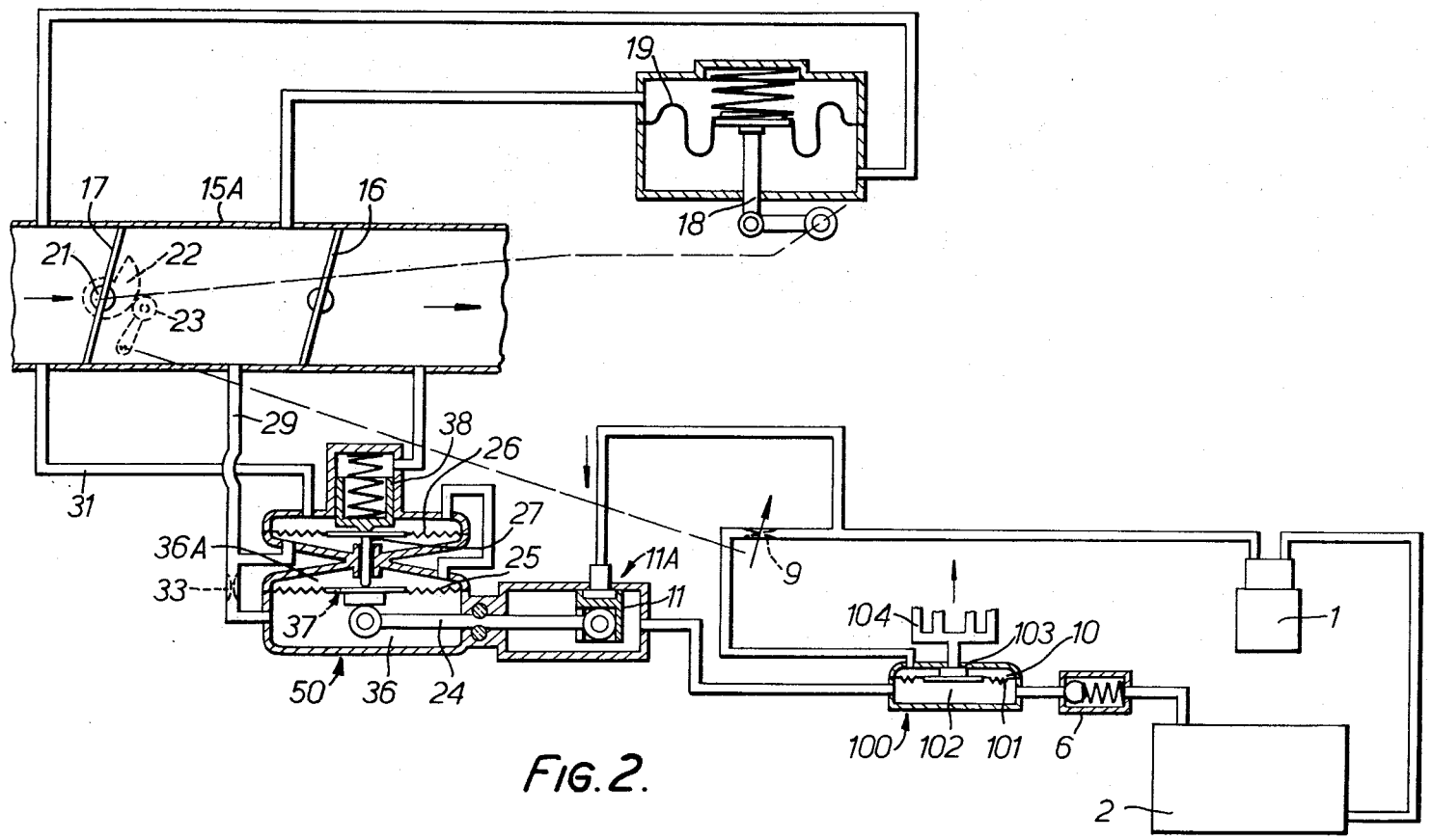
FIG. 2 is a diagram of another system embodying the invention.

FIG. 2 shows another system embodying the invention. The system is generally similar to that shown in FIG. 1 and corresponding components carry similar references.

The system differs from that of FIG. 1 in the location of the pressure control valve 11A. More particularly, in the system of FIG. 2 the valve 11A is connected to receive fuel from the upstream side of the metering valve 9, fuel flowing through the valve 11A being returned to the tank 2 through the regulator 6. The valve member 11 of valve 11A is a button-type member mounted directly on one end of the rocking lever 24 of the pressure control unit 50. The other end of lever 24 is biased by a diaphragm 26 in dependence on the pressure drop across the air valve 17 exactly as described above with reference to FIG. 1 except that, in this case, an increase in the biasing force acts to close rather than open the valve 11A. As a result, the fuel pressure upstream of valve 11A is raised (above the standing pressure imposed by regulator 6) by an amount proportional to the pressure drop across the air valve 17.

The metering valve 9, as in the system of FIG. 1 meters fuel to a fuel store chamber 10. In this case, however, chamber 10 forms part of a distributor unit 100 and is separated, by a diaphragm 101, from a chamber 102 through which fuel flows from the pressure control valve 11A to the regulator 6. A valve member 103, mounted on the diaphragm 101, controls fuel flow from the chamber 10 to the electromagnetically-operated injectors (not shown) via individual fuel lines 104.

The valve member 103 operates to maintain the pressure in chamber 10 equal to that in chamber 102 (that is, the standing pressure imposed by regulator 6). The pressure upstream of the metering valve 9, on the other hand, is higher than this by an amount proportional to the pressure drop across the air valve 17: as a result the pressure drop across the metering valve 9 is determined, as in the system of FIG. 1, by the pressure drop across the air valve.

Adjustment of the metering valve 9 is also controlled, as already described for FIG. 1, by the air valve 17, the latter being coupled to the metering valve by the same cam and follower arrangement 22, 23. It will be seen accordingly, that the system functions exactly as described for FIG. 1 to maintain a desired ratio of fuel flow to air flow throughout the engine operating range.

The pressure control unit 50 of the system of FIG. 2 also incorporates a diaphragm 25 for augmenting the biasing force of diaphragm 26 when the engine is cold, as already described with reference to FIG. 1. In FIG.

2 the bleed restrictor 37 is shown as actually formed in the diaphragm 25 but the arrangement is equivalent to that of FIG. 1.

Similarly, the system of FIG. 2 also incorporates a piston 38 for engaging and thereby augmenting the biasing force of diaphragm 26 when the engine is developing full power, as already described for FIG. 1.

It will be appreciated that the diaphragm 25 of the storage mechanism and associated valve 33 are not essential features of the invention and could be omitted from the system shown in the drawing or replaced by some other arrangement for enriching the fuel/air mixture when the engine is cold. Alternatively, other arrangements similar to the cold-start arrangement 25, 33 could be provided to modify the fuel pressure in response to other factors, for example air temperature, oil temperature, air density, exhaust oxygen content. Similarly, the piston 38 is not an essential feature and could be omitted or replaced by some other arrangement for enriching the fuel/air mixture under full engine load conditions.

It will also be understood that the diaphragm 26 and lever 24 are provided to ensure that the amount of fuel supplied to the engine is compensated for variations in the pressure drop across the air valve 17. This enables a simple form of control for the air valve, such as that illustrated in the drawing, to be employed. If, however, a more complex form of air valve control were employed, serving to maintain the pressure drop across the air valve at a substantially constant value, then the compensating arrangement of the diaphragm 26 and beam 24 could be dispensed with.

I claim:

1. A fuel injection system for an internal combustion engine, including at least one injector nozzle, a fuel store, and at least one injector valve which is connected to receive fuel from the fuel store and which, when open, allows fuel from the store to be discharged by the said at least one injector nozzle, a metering valve operable to meter fuel continuously to the store at a rate dependent on an engine operating condition, and control means operable to open the injector valve intermittently whereby when the injector valve is closed, fuel delivered by the metering valve to the store is stored therein, the amount stored being dependent on the length of time during which the injector valve is closed and the metering rate of the metering valve, and when the injector valve opens, the stored amount of fuel is discharged by the injector nozzle, fuel being thereafter metered directly by the metering valve, through the store and injector valve, to the injector nozzle and discharged thereby until the injector valve closes.

2. A system as claimed in claim 1, in which the amount of fuel discharged is not materially dependent on the length of time the injector valve is open.

3. A system as claimed in claim 1, in which the control means is operable to open the injector valve for constant periods of time.

4. A system as claimed in claim 1, in which the control means is operable to open the injector valve for periods of time of a first length when the engine intake manifold depression is below a predetermined value and for periods of time of a second length when the intake manifold depression is above that value.

5. A system as claimed in claim 1, in which the control means is operable to open the injector valve for periods of time which vary in dependence on at least one engine operating condition.

6. A system as claimed in claim 1, in which the control means is operable to open the injector valve intermittently only under predetermined engine operating conditions, the injector valve being open continuously under other engine operating conditions.

7. A system as claimed in claim 1, in which the metering valve is operable to meter fuel at a rate dependent on air flow to the engine.

8. A system as claimed in claim 7, including an air valve which is located in the engine air intake conduit and which is movable in response to changes in the air flow to the engine, the metering valve being operable to meter fuel at a rate dependent on the position of the air valve.

9. A system as claimed in claim 8, including pressure control means operable to vary the pressure drop across the metering valve in dependence on the pressure drop across the air valve.

10. A system as claimed in claim 9, in which the pressure control means is operable to vary the pressure in the fuel store in dependence on the pressure drop across the air valve.

11. A system as claimed in claim 10, in which the pressure control means includes a pressure-responsive device exposed to the pressure drop across the air valve and in which the fuel store outlet includes a valve coupled to the said pressure-responsive device.

12. A system as claimed in claim 9, in which the pressure control means is operable to vary the pressure upstream of the metering valve in dependence on the pressure drop across the air valve.

13. A system as claimed in claim 12, including a valve which is connected to by-pass fuel from the metering valve, the pressure control means including a pressure-responsive device exposed to the pressure drop across the air valve and coupled to the said by-pass valve.

14. A system as claimed in claim 9, including means co-operable with the pressure control means to adjust the pressure drop across the metering valve in response to a change in an engine operating condition.

* * * * *